United States Patent [19]

Crum et al.

[11] Patent Number: 4,969,964

[45] Date of Patent: Nov. 13, 1990

[54] HEAT TREATMENT METHOD FOR REDUCING POLYTHIONIC ACID STRESS CORROSION CRACKING

[75] Inventors: James R. Crum, Ona; William G. Lipscomb, Barboursville; Pasupathy Ganesan, Huntington, all of W. Va.

[73] Assignee: Inco Alloys International, Inc., Huntington, W. Va.

[21] Appl. No.: 354,310

[22] Filed: May 19, 1989

[51] Int. Cl.[5] ..... C22D 19/05

[52] U.S. Cl. ..... 148/410; 148/13; 148/162; 148/428

[58] Field of Search ..... 148/410, 428, 13, 162

[56] References Cited

U.S. PATENT DOCUMENTS 3,859,060 1/1975 Eiselstein et al. ..... 420/448

OTHER PUBLICATIONS

"Microstructure and Phase Stability of INCONEL Alloy 617", W. Mankins, J. Hosier & T. Bassford, Metallurgical Transactions, vol. 5, Dec. 1974, pp. 2579–2590.

Analysis of Precipitated Phase in Heat Treated Inconel Alloy 617, Takahashi et al., Trans. Iron & Steel Institute of Japan, vol. 18, No. 221, 1978, pp. 221–224.

Structure/Property Relationships in Solid-Solution of Strengthened Superalloys, D. L. Klarstrom et al., Proc. Conf. "Superalloys 1984", AIME, 1984, 553–562.

INCONEL Alloy 617, Huntington Alloys Inc., 8–79, Copyright 1979.

*Primary Examiner*—R. Dean

*Attorney, Agent, or Firm*—Francis J. Mulligan, Jr.; Edward A. Steen

[57] ABSTRACT

A heat treatment of alloy 617 generally including 732° C.–927° C. (1350° F.–1700° F.) for about one hour. The resultant discontinuous carbide network in the grain boundaries inhibits stress corrosion crack growth in polythionic acid environments.

5 Claims, 2 Drawing Sheets

HEAT TREATMENT METHOD FOR REDUCING POLYTHIONIC ACID STRESS CORROSION CRACKING

TECHNICAL FIELD

The instant invention relates to heat treatment techniques in general and more particularly to method for reducing polythionic acid ($H_2S_xO_6$) stress corrosion cracking in a nickel-base alloy.

BACKGROUND ART

INCONEL ® alloy 617 (trademark of assignee) is a solid solution nickel-chromium- cobalt-molybdenum alloy exhibiting excellent high temperature strength and resistance to oxidizing and reducing environments. See U.S. Pat. No. 3,859,060. The alloy displays excellent resistance to a wide range of corrosive environments and is readily formed by and welded by conventional techniques. It is used, amongst other places, in demanding petrochemical applications where it generally provides excellent service.

The nominal chemical composition of INCONEL alloy 617 is shown below (in weight per cent).

| | BROAD | PUBLISHED |
|---|---|---|
| Nickel | Bal | 52 |
| Chromium | 20–24 | 22 |
| Cobalt | 9.5–20 | 12.5 |
| Molybdenum | 7–12 | 9.0 |
| Iron | | 1.5 |
| Alumium | 0.8–1.5 | 1.2 |
| Carbon | ≦.15 | 0.1 |
| Manganese | | 0.5 |
| Silicon | | 0.5 |
| Titanium | | 0.3 |
| Copper | | 0.2 |

The alloy is, however, susceptible to intergranular polythionic acid stress corrosion cracking. Cracking caused by polythionic acid can occur in the annealed condition or after long term exposure at simulated operating temperatures up to about 649° C. (1200° F.). Polythionic acid may be present in petrochemical environments. Failure of components made from INCONEL alloy 617 due to this or any other condition clearly cannot be tolerated.

SUMMARY OF INVENTION

Accordingly, there is generally provided a heat treatment for about 732° C.–927° C. (1350° F.–1700° F.) per one hour. The heat treatment apparently produces a discontinuous carbide network in the grain boundaries which inhibits crack growth and appears to be effective even after long time simulated service temperatures.

PREFERRED MODE FOR CARRYING OUT THE INVENTION

Figure 1:
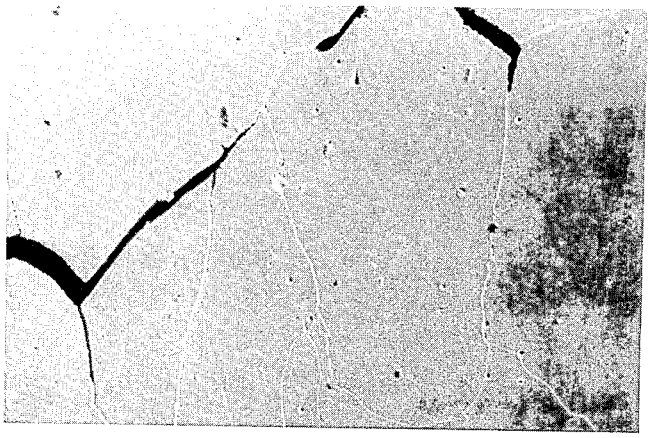
FIG. 1 is a 300x power scanning electron microscope photomicrograph of alloy 617 exposed to a polythionic acid environment in the as-annealed condition.

Alloy 617 is approved for ASME Boiler and Pressure Vessel Code use in Section I and Section VIII, Division 1 welded construction service by Code Case 1956-1. Maximum operating temperature is 899° C. (1650° F.). Alloy 617 seamless pipe and tube (12.7 cm [5 inch)] OD and under) is approved for Section VIII, Division 1 service to 982° C. (1800° F.) by Code Case 1982.

The effects of long term exposure at 538° C. to 760° C. (1000° F.–1400° F.) on both room temperature and operating temperature mechanical properties is a common question when designing a system. Precipitation of secondary phases in alloy 617 during long term exposure at 538° C.–760° C. (1000° F.–1400° F.) produces an increase in the room temperature yield and tensile strengths as well as reducing elongation.

These phases, carbides plus potential gamma prime, are responsible for the increase in room temperature yield and tensile strengths. As with any strengthening process there is a reduction in elongation. It is important to point out that the reductions in elongation are at room temperature and elongations are not affected at operating temperature.

Expansion joints for elevated temperature service represent a demanding application for an alloy. Added to the problems caused by elevated temperature environmental corrosion attack and elevated temperature strength demands is elevated temperature fatigue.

Low cycle fatigue strength is very important in elevated temperature service. Alloy 617 possesses excellent low cycle fatigue properties.

U-bend stress corrosion cracking ("SCC") and coupon intergranular attack tests were conducted on INCONEL alloy 617 cold rolled sheet and hot rolled plate 0.81–4.75 mm (0.032–0.187 inch)in the mill annealed (1177° C. [2150° F.] for about fifteen minutes) or mill annealed plus the heat treated conditions specified. All specimens were prepared for testing by sanding to a 120 grit surface finish prior to testing. Polythionic acid solution was prepared by bubbling sulfur dioxide gas through distilled water for 3 hours followed by hydrogen sulfide gas for one hour. The resulting solution was checked for potency by exposing an AISI 304 stainless steel U-bend sensitized by heat treatment at 677° C. (1250° F.) for two hours. Cracking within one hour indicated a solution suitable for use (Ref. ASTM G 35). All SCC tests were conducted at ambient temperature for a period of 720 hours.

In evaluating the U-bend specimens, time to crack was defined as the time required for formation of cracks large enough to be visible at 20X magnification. Time to fail was defined as the time required for cracking to advance to the point where tension was lost in the legs of the U-bend specimen. Intergranular attack (sensitization) tests were conducted in boiling 65% nitric acid (ASTM A 262, Practice C) and sulfuric acid-ferric sulfate (ASTM G 28, Practice A) tests.

In order to correlate the stress corrosion cracking response of alloy 617 in a polythionic acid ("PTA") environment with microstructure, selected samples in the as-annealed and annealed plus heat treated conditions were examined in optical and scanning electron microscopes (SEM). Also the phases present in the microstructure of the selected samples were identified by X-ray diffraction (XRD) analysis of the residues obtained by dissolving the matrix electrolytically in a 10% HCl-methanol solution. Samples for metallography and SEM were obtained from either leg or U-bend portion of the specimens and prepared following standard procedures for mounting and polishing. All the samples were then swab etched with Kalling's reagent. Samples for XRD analysis were obtained from leg portions of the selected samples.

CORROSION AND MICROSTRUCTURE RESULTS

A series of INCONEL alloy 617 heats were fabricated for testing purposes. Their chemical compositions are presented in Table 1. Two heats of INCOLOY® (trademark of assignee) alloy 800H from an earlier study were used for comparison purposes.

TABLE 1

The results of PTA SCC testing of alloy 617 with various heat treatments representing a wide range of possible service temperatures are listed in Tables 2–4. The results for alloy 800H are included for comparison.

TABLE 2, 3 and 4

Heat treatments from 427° C.–982° C. (800° F.–1800° F.) for up to 100 hours and the mill annealed condition are examined in Table 2. It is possible for alloy 617 to crack in the mill annealed condition and after exposure to temperatures of 649° C. (1200° F.) or below. No cracking occurred in the higher range of 704° C.–899° C. (1300° F.–1650° F.) but cracking did occur after exposure at 982° C. (1800° F.). This data represents 73 tests conducted on six heats of alloy 617. Only 18 of the 73 cracked and only 2 of the 73 cracked severely enough to cause complete failure of the specimen. For comparison, most of the alloy 800H specimens from the 649° C.–899° C. (1200° F.–1650° F.) temperature range cracked and many failed completely.

The absence of cracking after exposure to the 704° C.–899° C. (1300° F.–1650° F.) range suggests that a microstructural change may be occurring which inhibits PTA SCC. To explore this possibility, 760° C. (1400° F.) and 899° C. (1650° F.) heat treatments were applied prior to longer time service temperature simulations, Tables 3 and 4.

TABLE 1

| | Chemical Composition of Corrosion Test Materials | | | | | | | | | | | |
|---|---|---|---|---|---|---|---|---|---|---|---|---|
| Heat | C | Mn | Fe | S | Si | Cu | Ni | Cr | Al | Ti | Co | Mo |
| 1 | .07 | .03 | .41 | .002 | .15 | .09 | Bal | 21.89 | 1.21 | .30 | 12.54 | 9.03 |
| 2 | .08 | .04 | 1.18 | .001 | .17 | .12 | Bal | 21.89 | 1.03 | .25 | 12.42 | 9.29 |
| 3 | .06 | .01 | .87 | .002 | .11 | .01 | Bal | 22.23 | 1.17 | .30 | 12.47 | 9.20 |
| 4 | .07 | .02 | .15 | .007 | .08 | .01 | Bal | 22.31 | 1.06 | .35 | 12.46 | 9.09 |
| 5 | .06 | .18 | 1.03 | .001 | .12 | .02 | Bal | 21.93 | .96 | .49 | 11.71 | 8.84 |
| 6 | .06 | .07 | 2.13 | .001 | .19 | .17 | Bal | 21.90 | 1.10 | .23 | 12.43 | 8.89 |
| 7 | .06 | .89 | Bal | .002 | .22 | .61 | 31.24 | 20.22 | .52 | .50 | .05 | .30 |
| 8 | .08 | 1.01 | Bal | .002 | .36 | .64 | 31.26 | 20.43 | .37 | .39 | .08 | .38 |

Note:
Heats 1–6 are INCONEL alloy 617
Heats 7 and 8 are INCOLOY alloy 800H

TABLE 2

PTA U-bend Test Results - Effect of Simulated Service Exposure
Time to Crack (TTC)/Time to Fail (TTF), In Hours (Hr)

| Heat No. | Mill Anneal TTC/TFF | 425° C. (800° F.) TTC/TTF | 482° C. (900° F.) TTC/TTF | 538° C. (1000° F.) TTC/TTF | 593° C. (1100° F.) TTC/TTF | 649° C. (1200° F.) TTC/TTF | 649° C. (1200° F.) TTC/TTF | 703° C. (1300° F.) TTC/TTF |
|---|---|---|---|---|---|---|---|---|
| 1 | NC/NF | | NC/NF | 720/NF | 720/NF | NC/NF | 240/408 | |
| | NC/NF | | NC/NF | — | 720/NF | NC/NF | 240/576 | |
| 2 | 720/NF | 720/NF | 720/NF | 720/NF | 720/NF | | NC/NF | |
| | 720/NF | 720/NF | 720/NF | | — | | — | |
| | NC/NF | | NC/NF | | NC/NF | | NC/NF | |
| | NC/NF | | NC/NF | | 768/NF | | NC/NF | |
| 3 | NC/NF | | | | | | NC/NF | |
| | NC/NF | | | | | | NC/NF | |
| 4 | NC/NF | | | | | | 96/NF | |
| | NC/NF | | | | | | 96/NF | |
| 5 | NC/NF | | | | | | NC/NF | |
| | NC/NF | | | | | | NC/NF | |
| 6 | NC/NF | | | | | | NC/NF | |
| | NC/NF | | | | | | NC/NF | |
| 7 (800H) | NC/NF | | | | | 720/NF | 6/24 | 24/24 |
| 8 (800H) | 720/NF | | | | | 24/NF | 6/144 | 24/48 |

| Heat No. | 703° C. (1300° F.) 100 HR TTC/TTF | 760° C. (1400° F.) 1 Hr TTC/TTF | 871° C. (1600° F.) 1 Hr TTC/TTF | 871° C. (1600° F.) 100 Hr TTC/TTF | 897° C. (1650° F.) 1 Hr TTC/TTF | 982° C. (1800° F.) 100 Hr TTC/TTF |
|---|---|---|---|---|---|---|
| 1 | NC/NF | NC/NF | NC/NF | NC/NF | | |
| | NC/NF | NC/NF | NC/NF | NC/NF | | |
| | | NC/NF | | | | |
| | | NC/NF | | | | |
| 2 | NC/NF | NC/NF | | NC/NF | NC/NF | 768/NF |
| | — | NC/NF | | NC/NF | NC/NF | 312/NF |
| | | NC/NF | | | | |
| | | NC/NF | | | | |
| 3 | | | | | NC/NF | |

TABLE 2-continued

| PTA U-bend Test Results - Effect of Simulated Service Exposure Time to Crack (TTC)/Time to Fail (TTF), In Hours (Hr) | | | | | |
|---|---|---|---|---|---|
| | | | | | NC/NF |
| 4 | | | | | NC/NF |
| | | | | | NC/NF |
| 5 | | | | | NC/NF |
| | | | | | NC/NF |
| 6 | | NC/NF | | | NC/NF |
| | | | | | NC/NF |
| 7 (800H) | | 6/24 | 720/720 | 720/NF | |
| 8 (800H) | NC/NF | 6/48 | 240/720 | 144/NF | |

Note: Mill Anneal: solution anneal temperature 1177° C. (2150° F.) for fifteen minutes.
NC = No Crack
NF = No Fail

TABLE 3

| PTA U-bend Test Results - Effect of a 760° C. (1400° F.) Heat Treatment Time to Crack (TTC)/Time to Fail (TTF), in Hours (Hr) 760° C. (1400° F.) 1 Hr + Following | | | | | |
|---|---|---|---|---|---|
| Heat No. | 482° C. (900° F.) 100 Hr TTC/TTF | 593° C. (1100° F.) 100 Hr TTC/TTF | 703° C. (1300° F.) 100 Hr TTC/TTF | 871° C. (1600° F.) 100 Hr TTC/TTF | 982° C. (1800° F.) 100 Hr TTC/TTF |
| 2 | NC/NF | 768/NF | NC/NF | 312?/NF | 768/NF |
| | NC/NF | NC/NF | NC/NF | NC/NF | 312/NF |
| 7 (800H) | | <24/24 | | | |
| 8 (800H) | | 24/96 | | | |

TABLE 4

| PTA U-bent Test Results - Effect of 897° C. (1650° F.) Heat Treatment Time to Crack (TTC)/Time to Fail (TTF), in Hours (Hr) 897° C. (1650° F.) 1 Hr + Following | | | | | | | |
|---|---|---|---|---|---|---|---|
| Heat No. | 482° C. (900° F.) NC/NF | 538° C. (1000° F.) NC/NF | 593° C. (1100° F.) NC/NF | 649° C. (1200° F.) NC/NF | 649° C. (1200° F.) NC/NF | 760° C. (1400° F.) NC/NF | 760° C. (1400° F.) NC/NF |
| 1 | NC/NF | NC/NF | NC/NF | NC/NF | NC/NF | NC/NF | NC/NF |
| | NC/NF | NC/NF | NC/NF | NC/NF | NC/NF | NC/NF | NC/NF |
| 2 | | | | | NC/NF | | |
| | | | | | NC/NF | | |
| 3 | | | | | NC/NF | | |
| | | | | | NC/NF | | |
| 4 | | | | | NC/NF | | |
| | | | | | NC/NF | | |
| 5 | | | | | NC/NF | | |
| | | | | | NC/NF | | |
| 6 | | | | | NC/NF | | |
| | | | | | NC/NF | | |
| 7 (800H) | | | | | 24/48 | | NC/NF |
| 8 (800H) | | | | | 72/NF | | NC/NF |

The 760° C. (1400° F.)/1 hour heat treatment was not effective in preventing slight cracking, but the 899° C. (1650° F.)/1 hour treatment apparently inhibited cracking in alloy 617. In both cases alloy 800H cracked severely.

Results in Tables 2–4 show that PTA SCC of alloy 617 is difficult to produce in this severe test and not very reproducible. No significant heat to heat difference in SCC susceptibility could be found. Though most cracking was produced in heats 1 and 2 these were the two heats used most for testing. There is little difference in the chemical composition of the heats tested, Table 1.

Two intergranular attack (IGA) tests were conducted along with the SCC tests to determine if cracking could be correlated with intergranular sensitization, Tables 5 and 6.

TABLE 5 and 6

The various heat treatments caused a wide range of corrosion rates in the nitric acid (A 262, C) and sulfuric acid-ferric sulfate (G 28, A) tests. As might be expected 538° C.–760° C. (1000° F.–1400° F.) temperatures caused the most severe intergranular sensitization leading to IGA in these tests, Table 5. Corrosion rates agreed well between the two tests but high rates did not correlate well with PTA SCC susceptibility. Cracking occurred in alloy 617 sporadically at both high and low IGA rates. High rates always caused cracking in alloy 800H. The same pattern followed in the heat treatments of Table 6 except that no cracking occurred after a 899° C. (1650° F.) heat treatment. It is apparent that PTA SCC resistance cannot be predicted for alloys 617 and 800H by an IGA test alone.

XRD analyses obtained from all the samples indicated that the extracted residues were predominantly $M_{23}C_6$ carbides and TiN phases with a minor amount of $M_6C$ type carbide. The relative amount of $M_{23}C_6$ carbide (as compared to TiN and $M_6C$) increased with increasing temperature of heat treatment. The lattice parameter of $M_{23}C_6$ carbide did not change significantly with heat treatment. The lattice parameter, a, of the cubic $M_{23}C_6$ carbide was found to be 1.073 nm as compared to 1.062 nm for $Cr_{23}C_6$.

TABLE 5

| Heat Treatment | Corrosion Rate (Micrometers per year) in IGA Tests Heat Number | | | | | |
|---|---|---|---|---|---|---|
| | Test A | Test B | Test A | Test B | Test A | Test A |
| Mill Anneal | 119 | 20 | *215 | *30 | 25 | *5 |
| | | | 176 | 27 | | |
| 425° C. (800° F.)/100 Hr | | | *332 | | | |
| 482° C. (900° F.)/100 Hr | 553 | | *368 | *41 | | |
| 538° C. (1000° F.)/100 Hr | *943 | | *741 | *96 | | |
| 593° C. (1100° F.)/100 Hr | *>1000 | | *>1000 | | | |
| | | | *>1000 | *>1000 | | |
| 649° C. (1200° F.)/1 Hr | 748 | | | | *>1600 | *1700 |
| 649° C. (1200° F.)/100 Hr | *>1000 | *1000 | >1000 | >1000 | *>2500 | *>1800 |
| | >1000 | | | | | |
| 703° C. (1300° F.)/1 Hr | | | | | *>2500 | *>2400 |
| 703° C. (1300° F.)/100 Hr | 1000 | | >1000 | | 11 | 22 |
| | | | 410 | 95 | | |
| 760° C. (1400° F.)/1 Hr | >1000 | | >1000 | 209 | *>2000 | *>1700 |
| | 930 | 85 | | | | |
| 871° C. (1600° F.)/1 Hr | 23 | 15 | | | *262 | *220 |
| 871° C. (1600° F.)/100 Hr | 49 | | 532 | 27 | *92 | *28 |
| 928° C. (1800° F.)/100 Hr | | | *47 | *48 | | |

*Cracking in PTA SCC Test
Tests:
A: Boiling 65% Nitric Acid (ASTM A 262, Practice C)
B: Boiling Sulfuric Acid - Ferric Sulfate (ASTM 28, Practice A)
Mill Anneal: See Table 2

TABLE 6

| Heat Treatment | Corrosion Rate (Micrometers per year) in IGA Tests Heat Number | | | | |
|---|---|---|---|---|---|
| | 1 Test A | 2 Test A | 2 Test B | 7 Test A | 8 Test A |
| 1400° F./1 Hr + 900° F./100 Hr | | >1000 | 230 | | |
| 1400° F./1 Hr + 1100° F./100 Hr | | *>1000 | *>1000 | *>1700 | *>1300 |
| 1400° F./1 Hr + 1300° F./100 Hr | | 826 | 258 | | |
| 1400° F./1 Hr + 1600° F./100 Hr | | 760 | 30 | | |
| 1400° F./1 Hr + 1800° F./100 Hr | | *51 | *57 | | |
| 1650° F./1 Hr + 900° F./100 Hr | 93 | | | | |
| 1650° F./1 Hr + 1000° F./100 Hr | 270 | | | | |
| 1650° F./1 Hr + 1100° F./100 Hr | >1000 | | | | |
| 1650° F./1 Hr + 1200° F./100 Hr | 154 | | | | |
| 1650° F./1 Hr + 1200° F./100 Hr | >1000 | | | *755 | *431 |
| | >1000 | | | | |
| 1650° F./1 Hr + 1400° F./100 Hr | 136 | | | | |
| 1650° F. + 1400° F./100 Hr | 146 | | | | |

*Cracking in PTA SCC Test
Tests: See Table 5

This difference is possibly due to the partial substitution of Mo and Co for Cr. Based on the XRD analyses, indicating $M_{23}C_6$ carbide as a predominant phase with a fixed chemical composition, it appeared that the morphology of $M_{23}C_6$ carbide is possibly responsible for intergranular stress corrosion of alloy 617. In order to confirm that, selected samples were observed in an SEM and an optical metallograph.

An SEM micrograph of a sample cross-section that had been exposed to polythionic acid in the annealed condition (Heat 2, 720/NF) is shown in FIG. 1. The sample in this case was obtained from the U-bend portion. Intergranular stress corrosion cracks are immediately visible. The carbides are only on the grain boundaries in the as-annealed sample except for some primary $M_6C$ carbides and TiN randomly distributed throughout the microstructure. Upon higher magnification, it was observed that the grain boundary carbides are in the form of a continuous film enveloping the grains.

Further analyses of a grain boundary away from the cracks indicated that they were Cr rich with some Mo, Co and Ni. It can be concluded that the continuous film found along the grain boundary was a Cr depleted region and the precipitate therein is $M_{23}C_6$ carbide. From the microstructure it is clear that the continuous film-like morphology has led to PTA stress corrosion cracking susceptibility of the alloy in the annealed condition.

Sheet like morphology has been shown to increase intergranular corrosion in type 304 stainless steel. It is believed that electrochemical corrosion due to difference in the nobility of the grain boundary precipitates and adjacent matrix takes place and the continuous nature of the grain boundary film provides a continuous path for the acid solution to continue the attack from one grain to the next.

Figure 2:
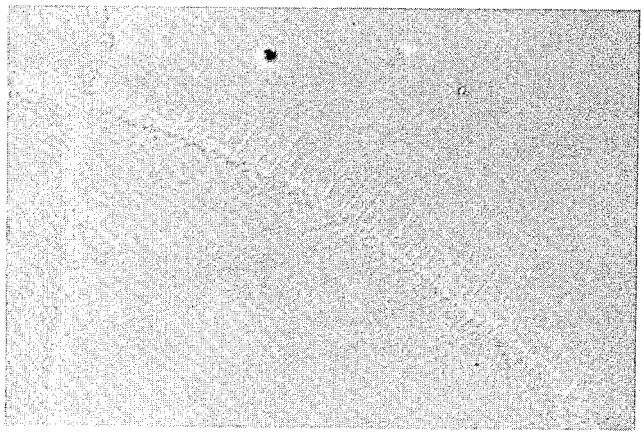
FIG. 2 is a 2000x power scanning electron microscope photomicrograph of alloy 617 annealed plus heat treated at 649° C. (1200° F.) for 100 hours.

A SEM micrograph of the cross-section of a sample annealed and then heat treated at 648° C. (1200° F.) for 100 hours (Heat 1, 240/408) is shown in FIG. 2. In this case, in addition to the grain boundary carbides, $M_{23}C_6$ carbides are precipitated internally as well. The grain boundary shows a hairy or zipper like appearance. The carbides that appeared hairy at lower magnifications (not shown) can be described as "zipper-like" Widmanstatten based in higher magnification SEM micrographs (not shown). These carbides appear to originate in the grain boundary and grow into the grain along certain crystallographic directions. This type of morphology would reduce toughness by reducing ductility and therefore is very detrimental.

Figure 3:
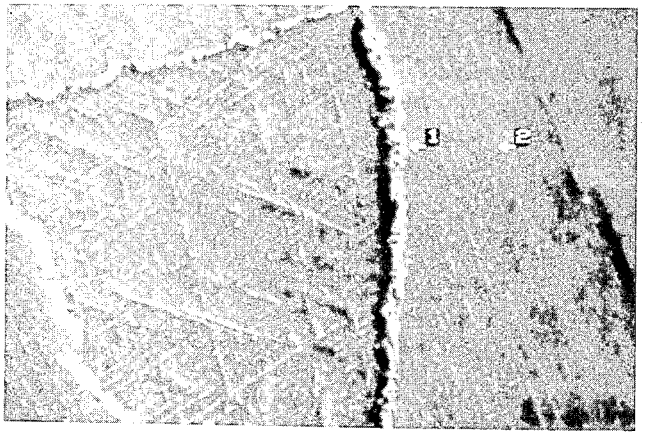
FIG. 3 is a 4000x power scanning electron microscope photomicrograph of alloy 617 heat treated at 900° C. (1650° F.) for one hour plus 649° C. (1200° F.) for 100 hours.

An SEM micrograph from the cross-section of a specimen heat treated at 899° C. (1650° F.) for 1 hour plus 648° C. (1200° F.) for 100 hours (Heat 1, NC/NF,) is shown in FIG. 3. Discrete $M_{23}C_6$ carbides can be seen (arrows 1 and 2) on the grain boundary as well as within the grains. Also the grain boundary stands out in relief for the sample in the annealed condition. It is likely that long aging may have redistributed chromium sufficiently evenly that grain boundary depletion of chromium may be minimal or absent. Also the precipitates on the grain boundary are relatively discontinuous. The alloy therefore is more resistant to PTA stress corrosion cracking at the higher aging temperature.

In summary, it appears that the PTA stress corrosion cracking tendency of alloy 617 is related to the carbide morphology at the grain boundary. The continuous film-like and Widmanstatten morphologies of $M_{23}C_6$ carbides obtained in the as-annealed and annealed plus low temperature heat treated condition respectively are more likely to cause SCC and reduced ductility.

On the contrary, and according to the invention in the annealed plus high-temperature heat treated condition i.e., generally about 732° C. (1350° F.)–927° C. (1700° F.) for about one hour and preferably at 897° C. (1650° F.) for about an hour, the morphology of grain boundary $M_{23}C_6$ carbides was discontinuous and massive and therefore the grain boundaries are not prone to cracking.

The instant heat treatment method may be employed for most annealed typical industrial alloy 617 shapes, i.e, sheets, plate standard tubing, billets, etc.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. An article of manufacture exhibiting resistance to polythionic acid stress corrosion cracking consisting essentially of about 20–24% chromium, about 9.5–20% cobalt, about 7–12 molybdenum, about 0.8–1.5% aluminum, balance nickel, the article heat treated from about 1350° F. (732° C.) to about 1700° F. (927° C.) for about one hour.

2. The article of manufacture according to claim 1 including about 52% nickel, about 22% chromium, about 12.5% cobalt, about 9.0% molybdenum, about 1.2% aluminum, and about 1.5% iron.

3. The article of manufacture according to claim 1 heat treated at about 1650° F. (899° C.) for about one hour.

4. The article of manufacture according to claim 1 including a morphology of discontinuous $M_{23}C_6$ carbides along a grain boundary therein to inhibit polythionic acid stress corrosion cracking.

5. The article of manufacture according to claim 1 annealed prior to the heat treatment.

* * * * *